US005127465A

United States Patent [19]

Fischer

[11] Patent Number: 5,127,465

[45] Date of Patent: Jul. 7, 1992

[54] HEAT EXCHANGER

[75] Inventor: Warren Fischer, St. Charles, Ill.

[73] Assignee: Fischer Industries, Inc., Geneva, Ill.

[21] Appl. No.: 635,281

[22] Filed: Dec. 28, 1990

[51] Int. Cl.[5] ..... F25B 29/00; G03D 13/00

[52] U.S. Cl. ..... 165/30; 165/140; 354/299; 354/324; 392/495

[58] Field of Search ..... 165/30, 168, 140; 392/484, 495; 354/299, 324

[56] References Cited

U.S. PATENT DOCUMENTS

| | | | |
|---|---|---|---|
| 2,852,232 | 9/1958 | Marwell | 165/30 |
| 3,782,456 | 1/1974 | Gusmer | 165/164 |
| 5,027,145 | 6/1991 | Samuels | 354/299 |

FOREIGN PATENT DOCUMENTS

| | | | |
|---|---|---|---|
| 3112651 | 10/1982 | Fed. Rep. of Germany | 392/484 |
| 2311471 | 12/1976 | France | 392/484 |

*Primary Examiner*—Allen J. Flanigan

*Attorney, Agent, or Firm*—Polster, Lieder, Woodruff & Lucchesi

[57] ABSTRACT

A cast aluminum body has a plurality of stainless steel conduits and an electrical heating element cast therein. Water is circulated through one of the conduits, and the fluid to be heated is circulated in the remaining conduits. The electrical heating element heats the aluminum casting in response to a signal created by a heat sensor located in the fluid to be heated. As the temperature of the aluminum casting rises, the heat will be transferred from the aluminum to the conduits and then to the fluid passing through the conduits. In this regard, the casting of the conduits in the aluminum body results in a very intimate contact between the cast aluminum and stainless conduits which provides very efficient heat transfer. When the fluid to be heated attains the desired temperature, the sensor deenergizes the heating element. The water circulating through one of the conduits and the aluminum body act as a heat sink to substantially eliminate any undesirable heating of the aluminum body after the heating element is shut off.

20 Claims, 1 Drawing Sheet

HEAT EXCHANGER

BACKGROUND OF THE INVENTION

This invention relates, generally, to a heat exchanger and, more particularly, to a heat exchanger for use with a film developing apparatus.

Film developing apparatuses, such as those used to develop x-ray film, typically consist of a plurality of driven rollers for conveying an exposed film through a liquid developer bath, a liquid fixer bath, and a rinsing bath. The developer and fixer baths typically consist of alkaline and acidic solutions, respectively, and the rinsing bath typically consists of water.

As is well known, the developer and fixer solutions must be heated and maintained within a narrow temperature range to properly develop the film. In the past this was done by locating a heating coil in the developer and fixer baths. The heating coil would be energized in response to a signal generated by a temperature sensor disposed in the baths. The coils located directly in the baths are satisfactory if the containers holding the baths are constructed of stainless steel. However, in recent years, the stainless steel baths have been replaced by plastic containers because of their lower cost and greater ease of manufacturing. The known heating elements, when placed directly in the plastic containers can melt the plastic and, in extreme conditions, cause the containers to catch on fire. Attempts to carefully monitor the heating elements to avoid these undesirable results have proved unsuccessful.

Thus a heat exchanger that can heat the developer and fixer solutions without contacting or being in proximity to the plastic containers or other plastic components is desired. Such a heat exchanger, while having particular applicability to the film developing art, can be used in any application where the transfer of heat to a fluid is desired.

SUMMARY OF THE INVENTION

The present invention overcomes the above-noted shortcomings of the prior art and consists of a cast aluminum body having a plurality of stainless steel conduits and an electrical heating unit cast therein. Water is circulated through one of the conduits, and the fluid to be heated is circulated in the remaining conduits. The electrical heating element heats the aluminum casting in response to a signal created by a heat sensor located in the fluid to be heated. As the temperature of the aluminum casting rises, the heat will be transferred from the aluminum to the conduits and then to the fluid passing through the conduits. In this regard, locating the conduits and heating element in the mold for the aluminum body prior to the casting the body results in a very intimate contact between the cast aluminum body and the conduits and heating element which provides very efficient heat transfer therebetween. When the fluid to be heated attains the desired temperature the sensor shuts off the heating element. The temperature in the aluminum body will continue to rise after the heating element is shut off. This temperature increase would cause peaks of heat to be delivered to the fluid making control of the fluid temperature difficult. By circulating cooling water through one of the conduits, the cooling water and aluminum body act a heat sink to substantially eliminate any undesirable heating of the fluid after the heating element is shut off.

OBJECT OF THE INVENTION

It is a general object of the invention to provide an improved heat exchanger for heating fluids.

It is another object of the invention to provide an improved heat exchanger particularly adapted for use in a film developing machine.

It is a further object of the invention to provide an improved heat exchanger that can efficiently transfer heat and control the temperature of the fluids to be heated.

Other objects of the invention, in addition to those set forth above, will become apparent to one of ordinary skill in the art from the following description of the invention.

DETAILED DESCRIPTION OF THE INVENTION

Figure 1:
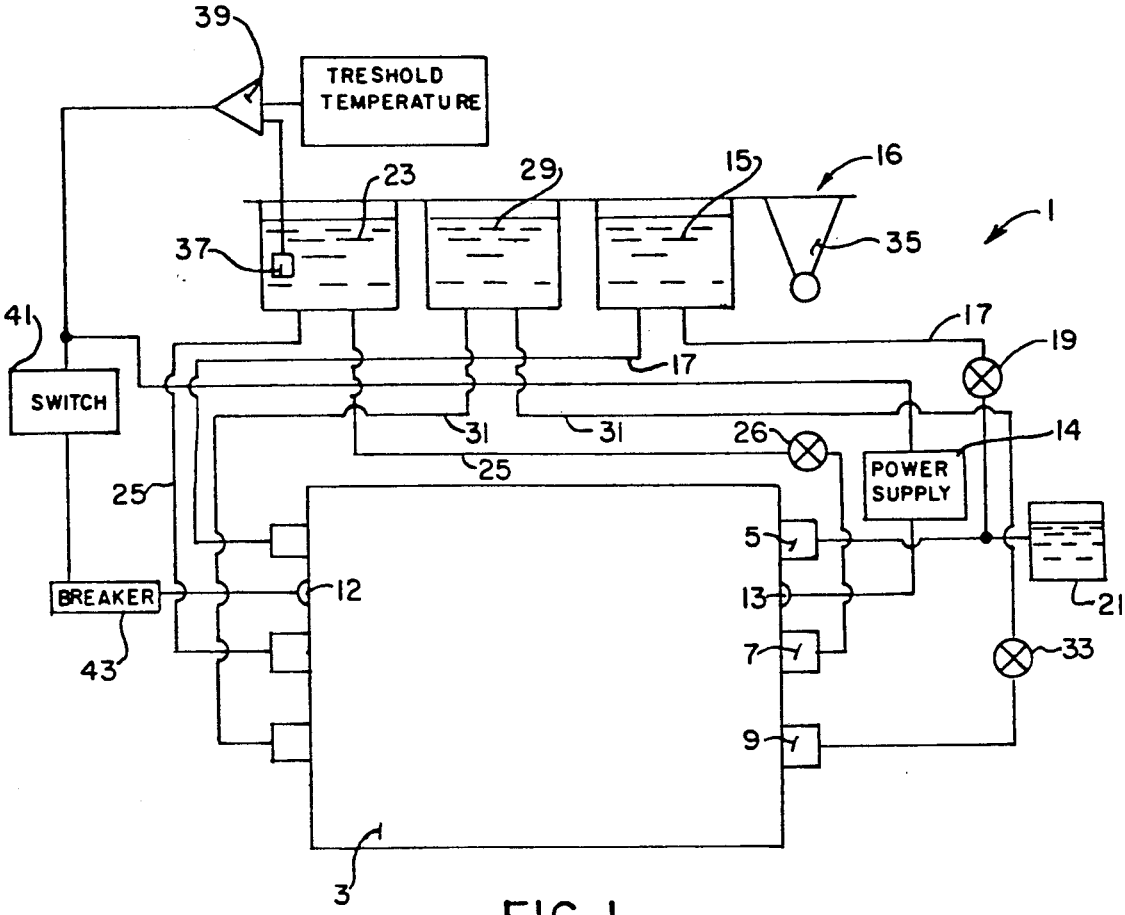
FIG. 1 is a side view of the invention in association with a film developing system.
Figure 2:
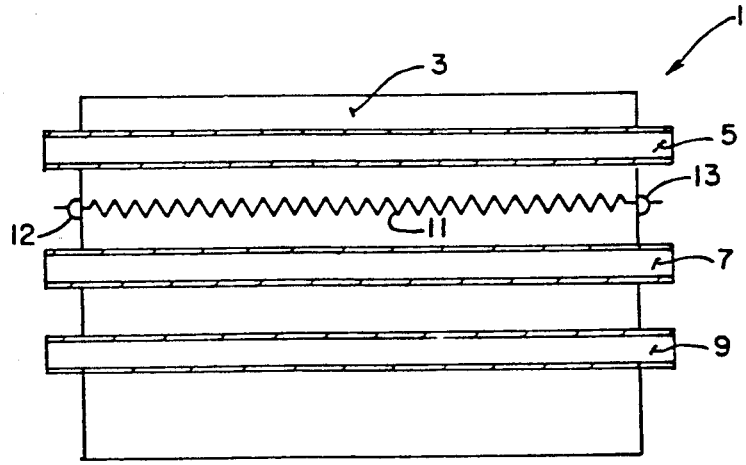
FIG. 2 is a section view of the heat exchanger of the invention showing the interior structure of the device.

The heat exchanger of the invention is shown generally at 1 in the figures and consists of a cast aluminum body 3 having a plurality of stainless steel conduits 5, 7 and 9 cast therein. By casting the body and conduits in a single casting process, intimate contact is obtained between the aluminum body 1 and the entire outer surface of the conduits 5, 7 and 9. As a result, there are no air gaps between the conduits and the aluminum body which would act as an insulator and inhibit the exchange of heat between the aluminum body and conduits.

A heating element 11, such as an electrically resistive coil, is also cast in the aluminum body 3 during the casting process. As with the conduits 5, 7 and 9, use of the casting process ensures intimate contact between the aluminum body and heating element 11 such that maximum heat transfer results. The electric coil includes terminals 12 and 13 adapted to be connected to an electrical power source 14.

In a preferred form of the invention, the heat exchanger is used in association with a film developing apparatus 16 as shown in FIG. 1. However, it is to be understood that the heat exchanger 1 can be used in any system where the efficient and controlled heating of a fluid is desired.

Referring more particularly to FIG. 1, conduit 5 is connected to the rinsing bath 15 of film developing unit 16 via line 17. A pump 19 maybe located in line 17 to convey the water through the rinsing system. A water source 21 is also connected to line 17 to periodically replenish the supply of water to the rinsing bath 15.

Conduit 7 is connected to a developer bath 23 via line 25. A pump 26 is provided to recirculate the developer solution around the closed developer bath path. Similarly conduit 9 is connected to a fixer bath 29 via line 31. A pump 33 circulates the fixer solution about the closed fixer solution path.

The film developing unit 16 also includes a plurality of rollers (not shown) for conveying exposed film into contact with the solution in each of the baths as will be understood by one skilled in the art. A drier 35 is provided to dry the developed film before it exits the film developing unit.

The heat exchanger of the invention also includes a temperature sensor 37 such as a thermistor disposed in the fluid to be heated. In the illustrated embodiment, temperature sensor 37 delivers a signal representing the temperature of the developer solution to a comparator 39. The comparator 39 compares the temperature of bath 23 to a threshold temperature and if the actual temperature is below the threshold temperature, comparator 39 turns on switch 41 to deliver current to heat element 11. Switch 41 can, for example, be a triac, relay or transistor. The flow of current to element 41 will be interrupted by switch 11 when the comparator 39 indicates that the temperature of bath 23 is equal to the threshold temperature.

A safety switch 43 such as a circuit breaker can be included in the circuit to automatically interrupt the flow of current to element 11 when switch 43 senses an abnormally high temperature. Safety switch 43 can be a manually operated type so as to be able to be reset when the cause of the abnormally high temperature is rectified.

In operation, the fluid to be heated is pumped through conduits 7 and 9. While two conduits are shown, it is to be understood that a greater or lesser number can be used as desired. Water is also pumped through conduit 5.

When sensor 37 detects a temperature in bath 23 below the threshold limit set on comparator 39, the comparator 39 instructs switch 41 to deliver electric current to heating element 11. The resistance in heating element 11 causes it to get hot. This heat is transferred to aluminum body 3 because of the intimate contact between heating element 11 and body 3 resulting from the casting process. As the aluminum body 3 heats up, the heat will be transferred to the stainless steel conduits 5, 7 and 9 through the aluminum because of the intimate contact between the conduits and the aluminum resulting from the casting process. The heat will be transferred from the conduits to the fluid being pumped through those conduits, and because conduits 7 and 9, are closed systems, the temperature of the fluid travelling through these conduits will steadily rise. Conversely, because the water path is an open system where the water is periodically replenished, the temperature of the water will remain relatively cool.

Once sensor 37 detects a temperature of bath 23 equal to the threshold temperature, comparator 39 will instruct switch 41 to interrupt the flow of current to the heating element 11. Although current is interrupted, the heating element 11 will remain hot for an extended period of time after the current is interrupted. Without any way to control the heat so generated, the fluid in lines 7 and 9 would rise beyond the desired levels. Therefore, the relatively cool water flowing through conduit 5 acts as a heat sink to absorb the excess heat generated by element 12.

The heating element 11 will remain inactive until the detector 37 again senses a drop in the temperature of the fluid in bath 23 below the threshold temperature. When this occurs the heating element 11 its reactivated and the heating process is repeated. Thus, the heat exchanger of the invention can continuously, efficiently and accurately control the temperature of a fluid.

While the invention has been shown and described in some detail, it will be understood that this description and the accompanying drawings are offered merely by way of example and that the invention is to be limited in scope only by the appended claims.

What is claimed is:

1. A film developing apparatus comprising:

a) a bath of developer fluid;

b) a bath of fixer fluid;

c) a bath of cooling fluid;

d) a body made of heat conductive material;

e) a first transporting means disposed in said body for transporting developer fluid through said body, and means for delivering said developer fluid to said first transporting means;

f) a second transporting means disposed in said body for transporting fixer fluid through said body and means for delivering fixer fluid to said second transporting means;

g) a third transporting means disposed in said body for transferring cooling fluid through said body and means for delivering cooling fluid to said third transporting means; and h) heating means for heating said body for transferring heat to the body whereby the fixer fluid and developer fluid are heated as they pass through the first and second transporting means.

2. The film developer apparatus according to claim 1, wherein said first, second and third transporting means and said heating element are cast into said body.

3. The apparatus according to claim 1, further including means for controlling the operation of said heating means.

4. The apparatus according to claim 1, wherein said body is made of cast aluminum.

5. The apparatus according to claim 1, wherein said heating means comprises an electric resistance element.

6. The apparatus according to claim 1, wherein the fluid delivered through one of said conduits acts as a heat sink.

7. The apparatus according to claim 2, wherein said means for controlling includes a heat sensor disposed in said fluid.

8. The apparatus according to claim 7, wherein said means for controlling includes a means for energizing said heating means in response to a signal from said heat sensor.

9. In an apparatus comprising:

a) a bath of first fluid;

b) a bath of second fluid;

c) a bath of cooling fluid;

d) a body made of heat conductive material;

e) a first transporting means disposed in said body for transporting said first fluid through said body, and means for delivering said first fluid to said first transporting means;

f) a second transporting means disposed in said body for transporting said second fluid through said body and means for delivering said second fluid to said second transporting means;

g) a third transporting means disposed in said body for transporting said cooling fluid through said body and means for delivering said cooling fluid to said third transporting means; and;

h) heating means for heating said body for transporting heat to the body whereby said first fluid and said second fluid are heated as they pass through the first and second transporting means.

10. The apparatus according to claim 9 wherein said first, second and third transporting means and said heating element are cast into said body.

11. The apparatus according to claim 10 further including means for controlling the operation of said heating means.

12. The apparatus according to claim 9 wherein said body is made of cast aluminum.

13. The apparatus according to claim 9 wherein said heating means comprises an electric resistance element.

14. The apparatus according to claim 9 wherein the fluid delivered through one of said conduits acts as a heat sink.

15. The apparatus according to claim 10 wherein said means for controlling includes a heat sensor disposed in at least one of said first and said second fluids.

16. The apparatus according to claim 15 wherein said means for controlling includes a means for energizing said heating means in response to a signal from said heat sensor.

17. In an apparatus for developing film including a bath of developer fluid, a bath of fixer fluid, and a bath of cooling fluid, the improvement comprising means for regulating the temperature of at least one of said developer fluid and said fixer fluid, comprising a body made of heat conductive material, first transport means disposed in said body for transporting developer fluid through said fluid, and means for delivering said developer fluid to said first transporting means; second transport means disposed in said body for transporting fixer fluid through said body and means for delivering fixer fluid to said second transporting means; third transporting means disposed in said body for transferring said cooling fluid through said body and means for delivering cooling fluid to said third transporting means; heating means for heating said body for transferring heat to said body whereby the fixer fluid and developer fluid are heated as they pass through the first and second transporting means; and means for controlling the operation of said heating means.

18. The apparatus according to claim 17 wherein said means for controlling the operation of said heating means includes a sensor disposed in at least one of said fixer and said developer fluids.

19. The apparatus according to claim 18 wherein said means for controlling the operation of said heating means includes means for energizing said heating means in response to a signal from said heat sensor.

20. The apparatus according to claim 19 wherein said first, said second and said third transporting means and said heating element are cast into said body.

* * * * *